US006224349B1

(12) United States Patent
Iwanami et al.

(10) Patent No.: US 6,224,349 B1
(45) Date of Patent: May 1, 2001

(54) RECIPROCATING TYPE COMPRESSOR HAVING ORBITING VALVE PLATE

(75) Inventors: Shigeki Iwanami, Okazaki; Kazuhito Miyagawa, Kariya, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/369,458

(22) Filed: Aug. 6, 1999

(30) Foreign Application Priority Data

Aug. 27, 1998 (JP) ..... 10-241508

(51) Int. Cl.[7] ..... F04B 1/12; F01B 1/00
(52) U.S. Cl. ..... 417/269; 91/480
(58) Field of Search ..... 417/269, 272; 91/480, 485, 499

(56) References Cited

U.S. PATENT DOCUMENTS 3,074,345 * 1/1963 Scheflow ..... 103/37
3,908,516 * 9/1975 Burton et al. ..... 91/476
3,954,353 * 5/1976 Mokesch ..... 417/269
4,051,765 * 10/1977 Saito ..... 91/35
4,072,444 * 2/1978 Kaiser ..... 417/269
5,058,485 * 10/1991 Cardillo ..... 91/485

FOREIGN PATENT DOCUMENTS 5-202848 8/1993 (JP) .
8-144946 * 6/1996 (JP) .

* cited by examiner

*Primary Examiner*—Timothy S. Thorpe
*Assistant Examiner*—Timothy P. Solak
(74) *Attorney, Agent, or Firm*—Pillsbury Winthrop LLP

(57) ABSTRACT

In a swash plate type compressor, a rotational shaft makes a piston reciprocate through a swash plate. A suction valve plate is connected to an eccentric portion of the shaft and caused to orbit around an axis of the shaft by rotation of the shaft. Friction between the suction valve plate and a contacting end wall in which a suction port is formed naturally suppresses the rotational motion of the valve plate. Therefore, the valve plate substantially orbits about the shaft axis without rotating and opens and closes the suction port. A relative velocity between the valve plate and the end wall when the valve plate orbits without rotating is smaller than when the valve plate only rotates.

5 Claims, 3 Drawing Sheets

RECIPROCATING TYPE COMPRESSOR HAVING ORBITING VALVE PLATE

CROSS REFERENCE TO RELATED APPLICATION

This application is based on and incorporates herein by reference Japanese Patent Application No. Hei. 241508 filed on Aug. 27, 1998.

BACKGROUND OF THE INVENTION

1. Field of the Invention

The present invention relates to a reciprocating type compressor having a piston, and especially to a control valve thereof, such as a suction valve.

2. Description of Related Art

In a conventional reciprocating type compressor, a reed type valve is used as the suction valve. The reed valve is made of a thin metal plate, and is attached to the compressor as a cantilever-arm, with a free end covering the suction port. The reed valve is flexed by a pressure differential to rise slightly from the suction port, thereby opening the suction port. However, even when the suction port is so opened, the reed valve does not fully uncover and open the suction port. Therefore, when a reed valve is used as the suction valve, the suction port operates as a throttle, thereby reducing the suction efficiency. When the compressor is operating at a high rotational speed, this problem becomes significant.

For solving this problem, JP-A-5-202848 discloses a swash plate type compressor in which a rotary type valve is used as a suction valve instead of a reed valve. This rotary valve is cylindrically shaped, and the outer peripheral surface thereof includes a valve opening. The rotary valve is connected to a rotational shaft and rotates with the rotational shaft. Peripherally surrounding the rotational shaft and the rotary valve are a plurality of cylinders uniformly formed to be parallel to each other. Each cylinder includes a suction port opening on a wall surface thereof for selectively communicating with the valve opening of the rotary valve. The rotating rotary valve respectively opens and closes each cylinder suction port by respectively opening communication and closing communication between the rotary valve opening and each consecutive cylinder suction port as the rotary valve rotates. In such a compressor, a plurality of pistons installed in the cylinders are made to reciprocate inside the cylinders by a swash plate rotating with the rotational shaft, and compress fluid such as a refrigerant sucked into the cylinders.

However, the cylindrically shaped rotary valve is slidably rotationally installed inside a cylindrically shaped valve chamber formed in a cylinder block or housing, and rotates with an outer surface thereof frictionally rotationally sliding against the wall surface of the valve chamber. Thus, when the rotary valve rotates at a high speed, the relative velocity with respect to the wall surface increases, thereby requiring a sufficient supply of lubrication. Further, to obtain sufficient durability, it is necessary to use an expensive material for the cylinder block exhibiting high resistance to seizing and to provide a special surface coating on the friction surfaces, thereby increasing the manufacturing cost. Also, a clearance gap needs to be provided between the rotary valve and the wall surface due to machining limitations, thereby allowing the compressed fluid to leak through the gap and reduce compression efficiency. Further, if a large disc is used as the rotary valve instead of a cylinder, the rotating disc shaped rotary valve frictionally slides along the wall surface, thereby creating a large amount of friction force and reducing the compression efficiency.

SUMMARY OF THE INVENTION

A first object of the present invention is to provide a reciprocating type compressor in which an improved valve is provided for attaining high compression efficiency without reducing suction efficiency, as when a reed type valve is used.

A second object of the present invention is to provide a reciprocating type compressor in which an improved valve is provided for attaining high durability and reliability without using expensive seize-resistant materials and without providing special surface coatings, as when a rotary valve is used.

According to the present invention, a valve plate is rotatably connected to an eccentric portion of a shaft, to thereby provide substantially only orbital motion to the valve plate without substantial rotating motion. Thus, a relative velocity in orbital motion between the valve plate and a contacted surface having a fluid port is lower than that in rotational motion, thereby decreasing the friction therebetween. Therefore, the power reduction due to friction is small, the contacted surfaces do not seize, it is not necessary to use expensive seize-resistant materials, to provide special surface coatings and high quality surface finishes, or to increase lubrication. Further, each fluid port is mechanically opened and closed by the valve plate with a decreased flow resistance at the fluid port as compared to a reed valve operating by a pressure differential, thereby improving suction or discharge efficiency.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

Figure 1:
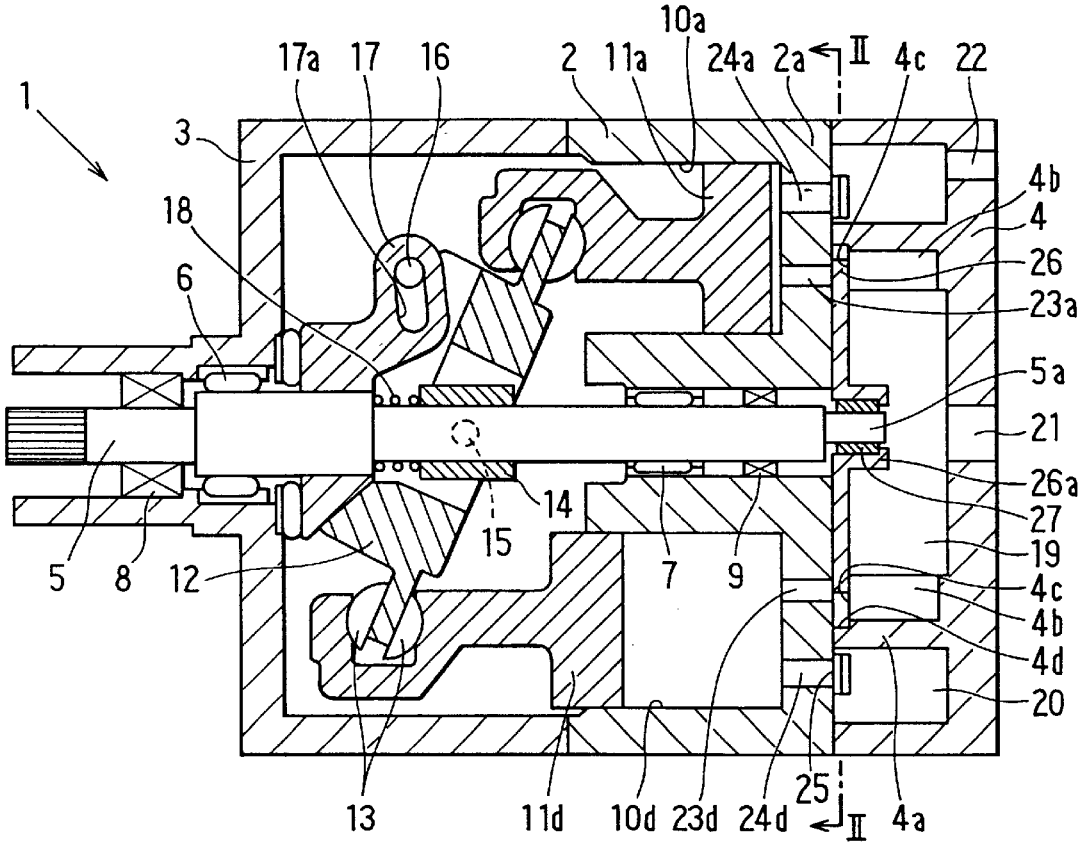
FIG. 1 is a cross-sectional view showing a swash plate type compressor according to the present invention.

In the presently preferred embodiment, a swash plate type compressor 1 is applied to a refrigerating cycle for an automotive air conditioning system. As shown in FIG. 1, an outer casing of the compressor 1 includes a cylinder block 2, a front housing 3 and a rear housing 4. The front and rear housings 2 and 3 are co-axially connected to the cylinder block 2 by through-bolts (not illustrated).

A shaft 5 is rotatably supported in the cylinder block 2 and the housings 3 and 4. The shaft 5 extends through the cylinder block 2 and front housing 3, to the inside of rear housing 4. The shaft 5 is supported by a front bearing 6 disposed in the front housing 3 and by a center bearing 7 disposed in the cylinder block 2. The shaft 5 transmits a rotational force from the vehicle engine to a compression mechanism of the compressor 1. A lip seal 8 is provided near the front bearing 6 to seal the gap between the shaft 5 and the front housing 3. Similarly, a lip seal 9 is provided near the center bearing 7 to seal the gap between the shaft 5 and the cylinder block 2. Therefore, the space inside the cylinder block 2 and front housing 3 is prevented from communicating with the exterior of the compressor 1 and the space inside the rear housing 4.

Figure 2:
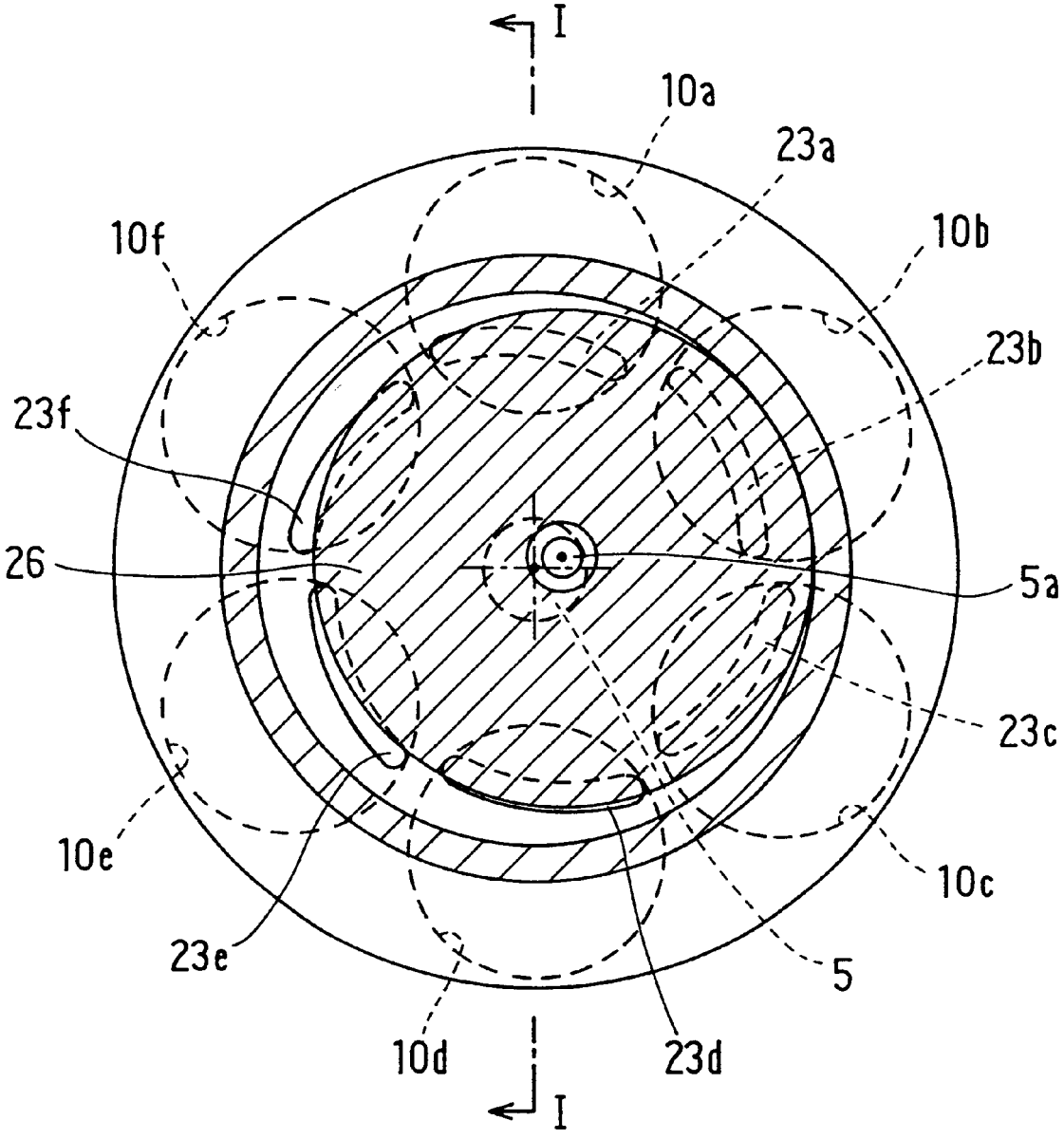
FIG. 2 is a partial cross-sectional view taken along line II—II in FIG. 1.

As shown in FIG. 2, six cylinders 10*a*–10*f* are formed in the cylinder block 2. The cylinders 10*a*–10*f* are uniformly positioned around the shaft 5 and are parallel therewith. Pistons 11*a*–11*f* are installed in each cylinder 10*a*–10*f* respectively to be allowed to slide therein. Each front end (left end in FIG. 1) of these pistons 11*a*–11*f* is slidably connected with respect to a swash plate 12 through a pair of shoes 13. Each pair of shoes 13 is provided at the front end of the piston 11 to position the ellipse shaped outer periphery of swash plate 12 therein.

The swash plate 12 is pinned on a sleeve 14 connected to shaft 5 by a pin 15, the axial direction of which is perpendicular to the shaft 5. The sleeve 14 is installed to axially slide along the shaft 5, thus allowing the swash plate 12 to incline with respect to the shaft 5. For allowing the swash plate 12 to incline, a pin 16 is provided at a particular portion of the swash plate 12 and an arm 17 is attached to the shaft 5. The arm 17 includes a radial cam groove 17*a*, and the pin 16 is positioned in the cam groove 17*a*. When the sleeve 14 slides along the shaft 5 due to the force canceling the urging force of spring 18, the pin 16 moves along the cam groove 17*a* to vary the inclination degree of the swash plate 12. As a result, the strokes of pistons 11*a*–11*f* are varied at the same time, thereby continuously varying the discharge capacity of the compressor 1.

In the swash plate type compressor 1 according to the present embodiment, compression counterforces arise in the cylinders 10*a*–10*f* when fluid such as refrigerant is compressed therein. The sum of these compression counterforces act on the sleeve 14 to slide it along the shaft 5 against the resisting force of spring 18. Further, a pressure inside the swash plate chamber where the swash plate 12 is disposed varies in accordance with cooling load. For example, when the cooling load is decreased, the swash plate chamber pressure rises to increase back pressure acting on the pistons 11*a*–11*f*. Thus, the sleeve 14 slides backwardly, i.e. towards the right side in FIG. 1, thereby reducing the tilt degree of swash plate 12 to reduce the stroke of the pistons 11*a*–11*f* and the discharge capacity of the compressor 1. In this way, the compressor discharge capacity varies in accordance with cooling load.

A suction chamber 19 is formed in the rear housing 4, and a ring-like discharge chamber 20 is formed around the suction chamber 19. The discharge chamber 20 is partitioned from the suction chamber 19 by a ring-like partition wall 4*a*. The suction chamber 19 communicates with an evaporator in a refrigeration cycle through a suction inlet 21, and the discharge chamber 20 communicates with a condenser in the refrigeration cycle through a discharge outlet 22. The cylinder block 2 and the rear housing 4 are partitioned from each other by the end wall 2*a* of the cylinder block 2.

Suction ports 23*a*–23*f* communicating with the suction chamber 19 and discharge ports 24*a*–24*f* communicating with the discharge chamber 20 are provided on the end wall 2*a* to correspond to each cylinder 10*a*–10*f* respectively. The discharge ports 23*a*–23*f* are round, while the suction ports 24*a*–24*f* are oval-shaped, as shown in FIG. 2.

Discharge valves 25 (not shown in FIGS. 2 and 3) are provided at each discharge port 24*a*–24*f* in the discharge chamber 20 for closing the discharge ports 24*a*–24*f*. Each discharge valve 25 is a reed type valve preventing the refrigerant from flowing back from the discharge chamber 20.

A disc-like suction valve plate 26 is provided in the suction chamber 19. The suction valve plate 26 is installed between the end wall 2*a* of the cylinder block 2 and the end surface 4*c* of radial wall 4*b* formed at the suction chamber 19 side of the ring-like partition wall 4*a*. The valve plate 26 is installed to have a gap in the axial direction to slide between the end wall 2*a* and the end surface 4*c*. As shown in FIG. 2, the valve plate 26 has a large enough diameter to close some of the suction ports 23*a*–23*f* and simultaneously open the others, while sliding as described above. The shaft 5 includes an eccentric portion 5*a* formed at a rear end thereof, and the eccentric portion 5*a* is inserted into a hub 26*a* formed at the center of the valve plate 26. That is, the suction valve plate 26 is rotatably supported by the eccentric portion 5*a* through a bearing 27, such as a metal bearing or needle bearing. An annular groove 4*d* is formed in the housing 4 to accomodate the outer periphery of valve plate 26 when the valve plate 26 orbits due to the rotation of shaft 5.

The suction valve plate 26 can be lightly biased toward the end wall 2*a* by a spring disposed in the suction chamber 19. Further, a simple structure rotation preventing mechanism can be added to the suction valve plate 26. The rotation preventing mechanism can include, for example, one or more rotation preventing pins placed at appropriate locations of the end wall 2*a* and protruding toward the suction chamber 19, and a circular hole formed on the valve plate 26. The circular hole is of sufficient diameter to receive the rotation preventing pin, and the rotation preventing pin is inserted into the circular hole to prevent the suction valve plate 26 from rotating. Thus, the suction valve plate 26 is allowed to orbit with respect to the center axis of the shaft 5 without rotating. Here, the size of the diameter of the circular hole is set at about the orbital diameter plus the diameter of the rotation preventing pin.

Even when the rotation preventing mechanism is not provided, because the valve plate 26 slides while being pushed to the end wall 2*a* or end surface 4*c*, friction forces arise therebetween to a certain degree. Thus, the rotation of valve plate 26 is suppressed by such friction forces, and the valve plate 26 orbits without substantially rotating. As described above, the relative velocity of valve plate 26 with respect to the end wall 2*a* or end surface 4*c* is much smaller than when the valve plate 26 rotates. Thus, dynamic losses caused by the friction between the valve plate 26 and the end wall 2*a* or end surface 4*c* are reduced.

Figure 3A:
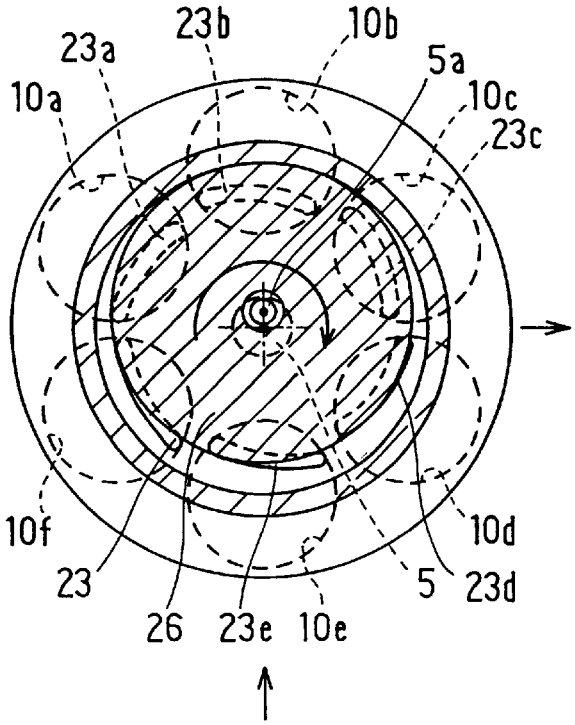
FIGS. 3A–3D are partial cross-sectional views taken along line II—II in FIG. 1, which sequentially show the operation of suction valve plate at consecutive 90° angles of rotation.

As will be understood from the structure described above, when the vehicle engine rotates the shaft 5, the rotation force is transmitted to the suction valve plate 26 through the eccentric portion 5*a*. Further, the friction force arises between the valve plate 26 and the end wall 2*a* or end surface 4*c* to a certain degree. Thus, the rotation of valve plate 26 is prevented, and the valve plate 26 orbits without rotating, as shown in FIGS. 3A–3D, which show the position of shaft 5 at 90 degree intervals. Hereinafter, the working of this embodiment will be explained by particularly describing the cylinder 10*a* operation. FIG. 3A shows the same condition as in FIG. 2 with the piston 11*a* positioned at top dead center, i.e. the final compression process in cylinder 10*a*. In this FIG. 3A condition, the valve plate 26 has been orbited to cover the suction port 23*a* of the cylinder 10*a*. Thus, the refrigerant is not being suctioned through suction port 23*a*. Further, at the same time, the compressed refrigerant is discharged out into the discharge chamber 20 through the discharge port 24*a* by the opening of the discharge valve 25.

Figure 3B:
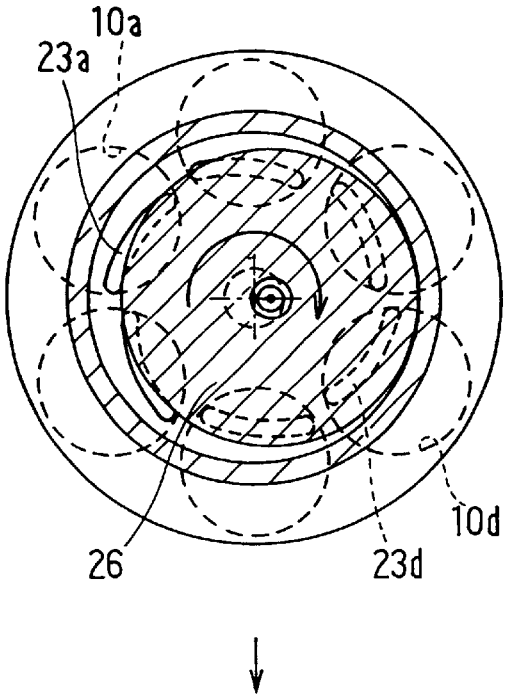

When the shaft 5 rotates as denoted by the arrows in FIGS. 3A–3D, the suction valve plate 26 orbits to slide rightwardly. Thus, the suction port 23*a* starts to be opened, and the suction chamber 19 communicates with the inside of cylinder 10*a*. The condition where the shaft 5 is rotated by 90° is shown in FIG. 3B. In this condition, the area of suction port 23*a* covered by the suction valve plate 26 is at a minimum, namely the opened area of the suction port 23*a* is maximized. Here, the timing when the opened area is at a maximum depends on the shape and location of suction port 23*a*, and phase relationship between the eccentricity direction of eccentric portion 5*a* and the pin 15 which is the tilt fulcrum of swash plate 12.

When the suction port 23*a* is fully or almost fully opened, the opened area of suction port 23*a* is comparatively large and the flow resistance at the suction port 23*a* is extremely small. Thus, the refrigerant pressure is not reduced as when a reed type suction valve is used. Further, the refrigerant does not have to work to open the suction valve plate 26 as when the reed type suction valve is used, with the suction port 23*a* being fully opened by a small mechanical force, thereby improving suction efficiency.

Figure 3D:
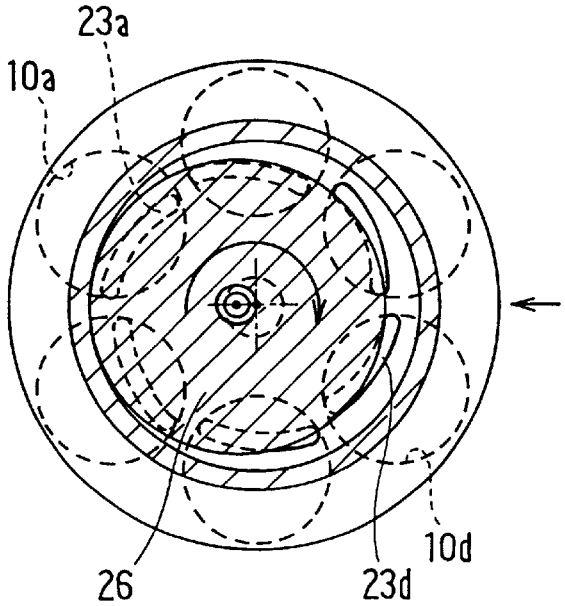
Figure 3C:
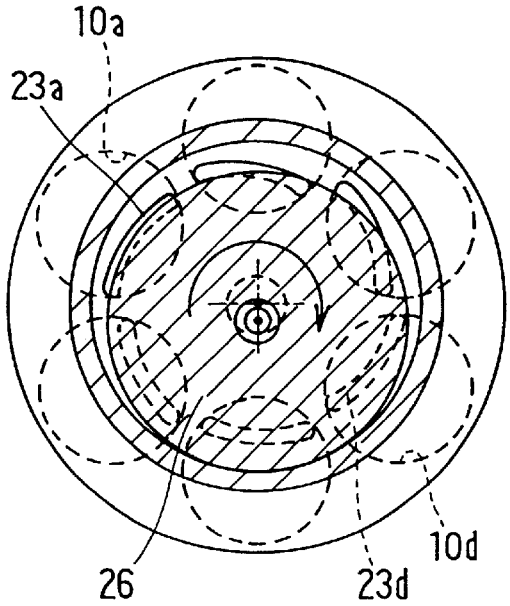

When the shaft 5 further rotates by 90°, as shown in FIG. 3C, the suction valve plate 26 orbits to slide down leftwardly and cover the suction port 23*a*. Thus, the opened area of the suction port 23*a* is nearly at a minimum. In this condition, the piston 11*a* is positioned at bottom dead center, similarly to the position shown in FIG. 1 of piston 11*d* in cylinder 10*d*, i.e. the final suction process in cylinder 10*a*. Sequentially, when the shaft 5 further rotates a little bit, the suction port 23*a* is fully closed, and the suction chamber 19 no longer communicates with the cylinder 10*a*.

FIG. 3D shows the compression process of cylinder 10*a*. In FIG. 3D, the piston 11*a* is stroking up from the bottom dead center of FIG. 3C to the top dead center of FIG. 3A, and the suction valve plate 26 has been orbited leftwardly to fully closed the suction port 23*a*. The refrigerant is compressed in the cylinder 10*a*, and when the refrigerant pressure reaches the set pressure of discharge valve 25, the reed type discharge valve 25 opens the discharge port 25*a* to discharge the compressed refrigerant into the discharge chamber 20. When the shaft 5 further rotates by 90° the suction valve plate 26 returns to the FIG. 3A position. In this way, a compression cycle is repeated. This compression cycle, including the suction process and compression process, is sequentially conducted in all of the cylinders 10*a*–10*f* with a 60° phase difference between each adjacent cylinder. Thus, the compressed refrigerant is almost continuously discharged into the discharge chamber 20, thereby keeping the discharged refrigerant pressure substantially constant with only a small pressure pulsation.

As described above, the suction valve plate 26 substantially only orbits without rotating. Because relative velocity in orbital motion between contacted surfaces is lower than that in rotational motion, it is not necessary to use expensive seize-resistant materials for the valve plate 26, end wall 2*a* or end surface 4*c*. Further, it is not necessary to provide special surface coatings or high quality surface finishes to these components for them to obtain sufficient durability and reliability. Also, because the relative velocity between the contacted surfaces is small, power loss is decreased in comparison to when the valve plate rotates, thereby increasing the working efficiency of compressor. And, because the opening area of suction port 23 is large, flow resistance at the suction port 23 is reduced in comparison with when a reed type valve is used as the suction valve, thereby improving the suction efficiency.

In the above-described embodiments, the suction port 23 is opened and closed by the valve plate 26. However, the valve plate 26 is not restricted to opening and closing the suction ports 23. Alternatively, it may be applied to open and close the discharge ports 24. The valve plate 26 need not be a circular disc, but may be alternatively shaped, having a corner, a concave portion and a hole. Further, the present invention has been described in connection with a swash plate type compressor. However, the present invention is not restricted to use in a swash plate type compressor and alternatively, may be applied to other reciprocating type compressors.

What is claimed is:

1. A reciprocating type compressor comprising:

a housing forming an outer casing;

a compression mechanism provided in said housing for suctioning and compressing fluid;

a shaft rotatably supported by said housing, said shaft transmitting a rotational force to said compression mechanism, said shaft including an eccentric portion being eccentric to a center axis of said shaft;

a suction chamber formed in said housing, from which the fluid is suctioned;

a discharge chamber formed around said suction chamber in said housing, to which the fluid is discharged;

a partition wall partitioning said discharge chamber from said suction chamber, said partition wall including a radial wall defining end surface and an annular groove;

an end wall having a suction port through which the fluid is suctioned from said suction chamber into said compression mechanism; and a valve plate provided between said end wall and the end surface of said radial wall and rotatably connected with said eccentric portion for substantially orbiting about the center axis by receiving a rotational force from said eccentric portion, wherein said valve plate opens and closes said suction port while orbiting the center axis, wherein said annular groove accommodates an outer periphery of said valve plate when said valve plate orbits the center axis.

2. A reciprocating type compressor according to claim 1, and further comprising:

a cylinder formed in said housing; and a piston installed in said cylinder to be allowed to axially slide and reciprocate therein, wherein said valve plate orbits in synchronization with the reciprocation of said piston.

3. A reciprocating type compressor according to claim 2, and further including a swash plate connected to said piston to reciprocate said piston in said cylinder.

4. A reciprocating type compressor according to claim 1, wherein an outer peripheral portion of said valve plate opens and closes said suction port.

5. A reciprocating type compressor according to claim 1, wherein said valve plate is formed like a disc.

* * * * *